United States Patent [19]

DeFazio

[11] Patent Number: 4,907,418

[45] Date of Patent: Mar. 13, 1990

[54] LIQUID HEATING SYSTEM PARTICULARLY FOR USE WITH SWIMMING POOLS OR THE LIKE

[76] Inventor: Louis C. DeFazio, 16603 Creeksouth, Houston, Tex. 77068

[21] Appl. No.: 270,836

[22] Filed: Nov. 14, 1988

[51] Int. Cl.[4] ..... F25B 27/00

[52] U.S. Cl. ..... 62/238.6; 165/159; 165/160

[58] Field of Search ..... 165/159, 160; 62/288.6

[56] References Cited

U.S. PATENT DOCUMENTS

| | | | |
|---|---|---|---|
| 2,716,860 | 9/1955 | Silva | 62/238.6 X |
| 3,498,072 | 3/1970 | Stiefel | 62/118 |
| 3,513,663 | 5/1970 | Martin, Jr. et al. | 62/159 |
| 3,926,008 | 12/1975 | Webber | 62/200 |
| 4,014,295 | 3/1977 | Lions | 165/160 X |
| 4,019,338 | 4/1977 | Poteet | 62/238 |
| 4,206,805 | 6/1980 | Beckett | 165/80.6 |
| 4,226,089 | 10/1980 | Barron | 62/84 |
| 4,279,128 | 7/1981 | Leniger | 62/238.6 |
| 4,464,909 | 8/1984 | Litzberg | 62/238.6 X |
| 4,507,933 | 4/1985 | Chapa et al. | 62/184 |
| 4,557,116 | 12/1985 | Kittler | 62/238.6 |
| 4,770,001 | 9/1988 | Reinhold | 62/238.6 |

FOREIGN PATENT DOCUMENTS

| | | | |
|---|---|---|---|
| 865997 | 4/1961 | United Kingdom | 165/160 |

*Primary Examiner*—William E. Wayner
*Attorney, Agent, or Firm*—Alan R. Thiele

[57] ABSTRACT

A swimming pool heating system includes in sealed tank, a refrigerant cooling coil system contained within the sealed tank and a water flow distribution manifold within the refrigerant cooling coil system. Cool swimming pool water is pumped through the water flow manifold such that is imparts a cyclical flow of water over the refrigerant cooling coil system. The warmth of the warmed refrigerant is imparted to the cool swimming pool water and the warmed swimming pool water then exits the water flow manifold and is returned to the swimming pool.

16 Claims, 3 Drawing Sheets

LIQUID HEATING SYSTEM PARTICULARLY FOR USE WITH SWIMMING POOLS OR THE LIKE

BACKGROUND OF THE INVENTION

The present invention relates to liquid heating systems; more particularly, the present invention relates to a liquid heating system for use with a swimming pool or the like.

The need for heating swimming pool water is recognized in both cold and warm climates. In warm climates the use of a swimming pool may be limited to only those months where the ambient temperature is sufficient to warm the swimming pool water to a comfortable level. In colder climates, swimming pool water must be continually heated in order to provide comfortable aquatic recreation.

In other situations there may be a need for warmed water. Such situations may include water used for plants in greenhouses or water used when raising animals. In still other situations, warmed water may be needed for washing or other industrial applications. (Because a swimming pool is exemplary of these needs, it will be used as the basis of the description which follows.)

One solution to the problem of heating swimming pool water has been the use of gas fired heaters. Such gas fired heaters are expensive to obtain and install; and, given the rising cost of natural gas, increasingly costly to operate. Consequently, the use of gas fired swimming pool water heaters has been somewhat limited.

The use of warmed refrigerant in a home air conditioning system to raise the temperature of swimming pool water was initially proposed in U.S. Pat. No. 3,498,072 to Stiefel. Therein, the substitution of a swimming pool water cooled condensor for an ambient air condensor was initially proposed. After that initial disclosure, other inventors devised more complex systems for automatic control of the flow of heated refrigerant and swimming pool water temperatures. Exemplary of such efforts are U.S. Pat. No. 3,926,008 to Webber, U.S. Pat. No. 4,019,338 to Poteet, U.S. Pat. No. 4,279,128 to Leniger and U.S. Pat. No. 4,557,116 to Kittler.

Despite the teachings of others on using waste heat from the warmed refrigerant in an air conditioning system to warm swimming pool water and the clear economic benefit as illustrated in U.S. Pat. No. 3,498,072 to Stiefel, no low cost, simple, commercially successful swimming pool water heating system has been produced. One of the reasons for this failure may be that none of the aforementioned attempts to produce a swimming pool water heating system has addressed the problem of providing a flow of water in sufficient quantity and at a sufficient velocity to obtain an effective amount of heat transfer from the warmed refrigerant. Additionally, the complexity of the swimming pool water heating systems taught in the aforementioned patents has elevated their cost of manufacture and rendered them uneconomical for residential or even limited commercial use.

There is therefore a need in the art to provide an inexpensive, easy to manufacture heating system for swimming pool water which utilizes the waste heat in the warmed refrigerant found in an air conditioning or refrigeration system. The swimming pool water heating system should be easy to install, easy to operate, long lasting and require little maintenance. Additionally, the heating system should provide a flow of water sufficient to allow an effective amount of heat transfer from the warmed refrigerant.

SUMMARY OF THE INVENTION

An inexpensive, easy to install, easy to operate and long lasting swimming pool water heating system, designed to utilize the waste heat from the warmed refrigerant in an air conditioning system is disclosed herein. The entire heating system is contained in a sealed tank located between the swimming pool and compressor-condensor system for the refrigerant. A first set of inlet and outlet connections are located on the sealed tank for the flow of swimming pool water and a second set of inlet and outlet connections are used for the flow of warmed refrigerant. Contained within the sealed tank is a refrigerant cooling coil system and a water flow manifold. It is the mechanical interaction of fluid flows caused by the refrigerant cooling coil system and the water flow manifold which effects the necessary heat transfer from the warmed refrigerant to the cool swimming pool water.

The compressor in the air conditioning system causes warmed refrigerant to flow into the refrigerant cooling coil system within the sealed tank. The pump normally used to circulate swimming pool water through the filter system is used to pump cool swimming pool water from the swimming pool through the water flow manifold within the sealed tank. The water flow manifold directs the flow of cool swimming pool water such that a cylindrical flow of water is created over the refrigerant cooling coil system. The heat from the warmed refrigerant is imparted to the cool circulating swimming pool water through the walls of the tubing in the refrigerant cooling coil system. The swimming pool water, now having absorbed the heat of the refrigerant, exits the sealed tank through a drain pipe in the water flow manifold and is returned to the swimming pool. The cooled refrigerant, is returned to the air conditioning system.

BRIEF DESCRIPTION OF THE DRAWINGS

A better understanding of the swimming pool water heating system of the present invention may be had by reference to the drawing figures wherein:

FIGS. 3A and 5B are alternate embodiment of the sealed tank; and

DESCRIPTION OF THE EMBODIMENTS

Figure 1:
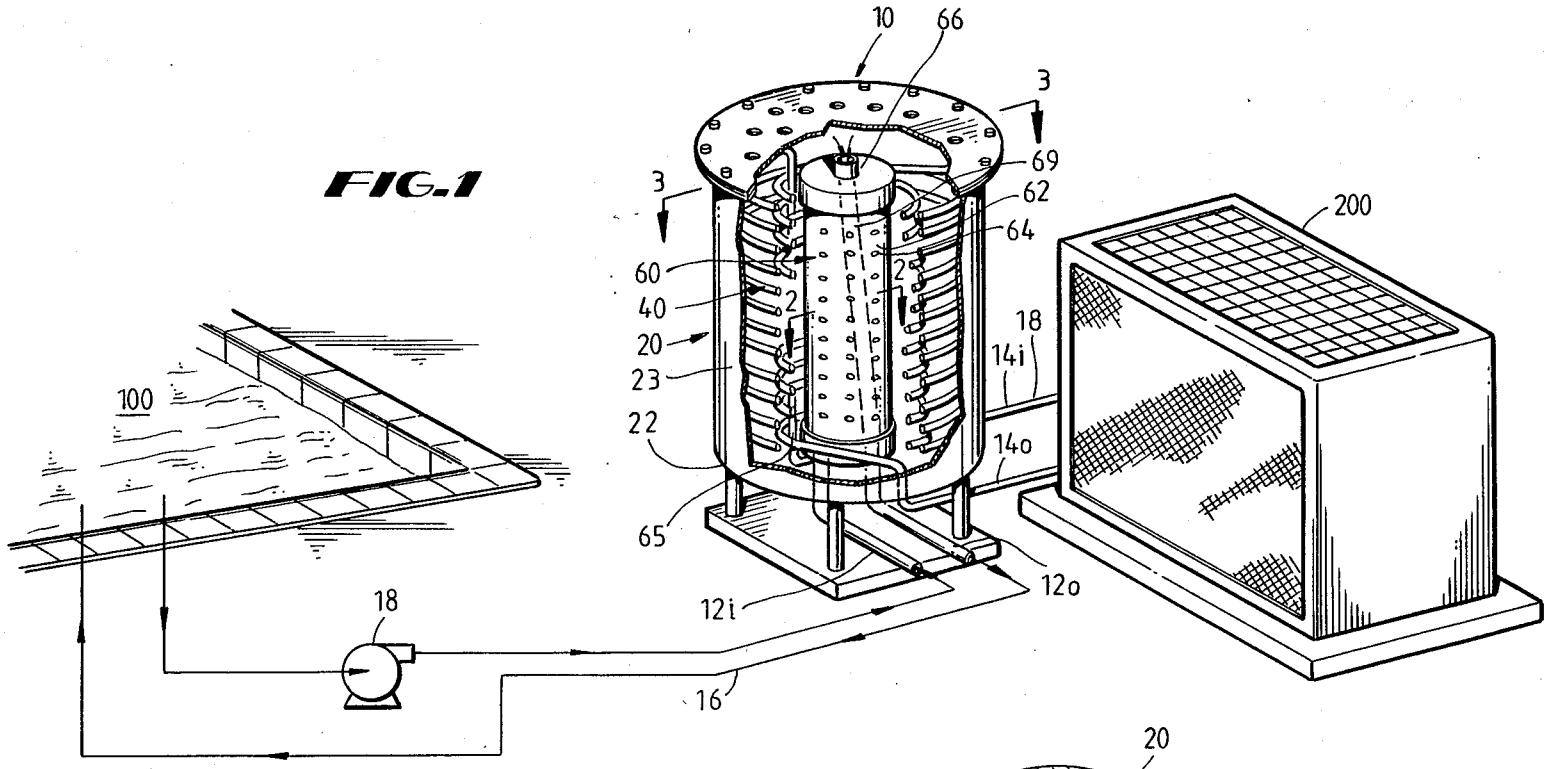
FIG. 1 is a partial schematic, partial perspective drawing of the swimming pool water heating system of the present invention with a portion of the sealed tank cut away.

While the liquid heating system of the present invention is susceptible of embodiment in many different forms, the preferred embodiment of the swimming pool water heating system has been shown in the drawings and will be described in further detail. It should be understood, however, that the present disclosure is to be considered only as an exemplification of the principle of the invention and is not intended to limit the invention to only the embodiments or application illustrated.

By way of background, a typical home air conditioning system uses refrigerant to cool circulating air. The refrigerant is pumped as a hot vapor by a compressor to a condensor where it is cooled to a liquid. From there, the refrigerant flows to an evaporator where the refrigerant is allowed to expand back into a gaseous or vapor state. The cycle is completed by conducting the refrigerant back to the compressor. In typical residential applications, the compressor-condensor system is located outside the house and the evaporator is located indoors.

The general construction and operation of the swimming pool water heating system 10 of the present invention is illustrated in FIG. 1. Shown between swimming pool 100 and the outdoor compressor-condensor unit 200 for an air conditioning or refrigeration system is swimming pool water heating system 10. In conventional outdoor compressor-condensor units for air conditioning or refrigeration systems, a fan is used to pass ambient air over condensor coils containing warm refrigerant. The waste heat from the warmed refrigerant is absorbed by the atmosphere. In the swimming pool water heating system 10 of the present invention, the waste heat from the warmed refrigerant is directed to the swimming pool water rather than to the atmosphere. Specifically, a swimming pool water cooled condensor is substituted for an air cooled condensor.

System 10 includes a sealed tank assembly 20, a refrigerant cooling coil system 40 and a water flow manifold assembly 60. Water from swimming pool 100 is conveyed to swimming pool heater system 10 through pipe or tubing system 16 and pump 18. This water enters and exits sealed tank assembly 20 through water inlet **12*i* and outlet 12*o* connections. Warmed refrigerant from the compressor-condensor system 200 is caused to flow to the refrigerant cooling coil system 40 through pipe or tubing system 18 and refrigerant inlet 14*i* and outlet 14*o* connections. Within sealed tank assembly 20 the waste heat from the warmed refrigerant utilized in the home air conditioning system is imparted to the cool swimming pool water through the walls of the tubing in the refrigerant cooling coil system 40**. While simple in principle, prior art systems have been complex and difficult to manufacture as well as not providing sufficient quantities and velocities of water flow to make such systems commercially desirable.

Figure 2:
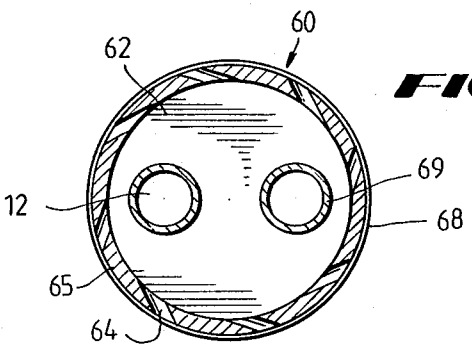
FIG. 2 is a sectional view at line 2—2 of FIG. 1.

With additional reference to FIG. 2, cool water from swimming pool 100 is conveyed by water inlet **12*i* in bottom 22 into the interior 23 of sealed tank assembly 20. Specifically, incoming water is conducted into the interior 62 of water flow manifold assembly 60. The cool swimming pool water exits water flow manifold assembly 60 through holes 64 formed in the side wall 65 of water manifold assembly 60**.

Figure 3:
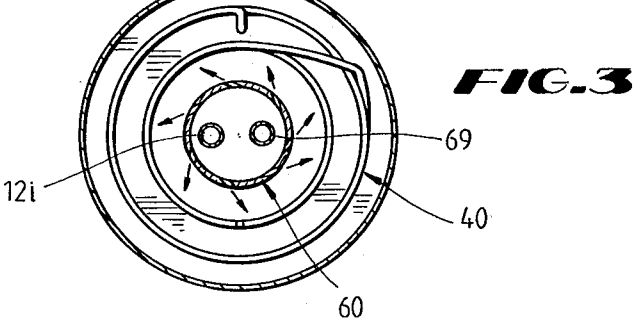
FIG. 3 is a sectional view at line 3—3 of FIG. 1.

With further reference to FIG. 3, the orientation of holes 64 in water flow manifold assembly 60 imparts a cylindrical flow to the water as it exits water flow manifold assembly 60. The combined area of holes 64 is approximately equal to or less than the area of water inlet **12*i*. As the cool swimming pool water flows over refrigerant cooling coil system 40, waste heat from the warm refrigerant is transferred through the tubing walls to the clyindrical flowing cool swimming pool water. The swimming pool water, now having been warmed by the refrigerant, begins its exit from sealed tank assembly 20 through top 66 of water flow manifold assembly 60 then through drain tube 69 and out through water outlet 12*o* on its way back to swimming pool 100. Cooled refrigerant is returned through outlet 14*o*** to evaporator (not shown) for reuse in the home air conditioning system.

Figure 4:
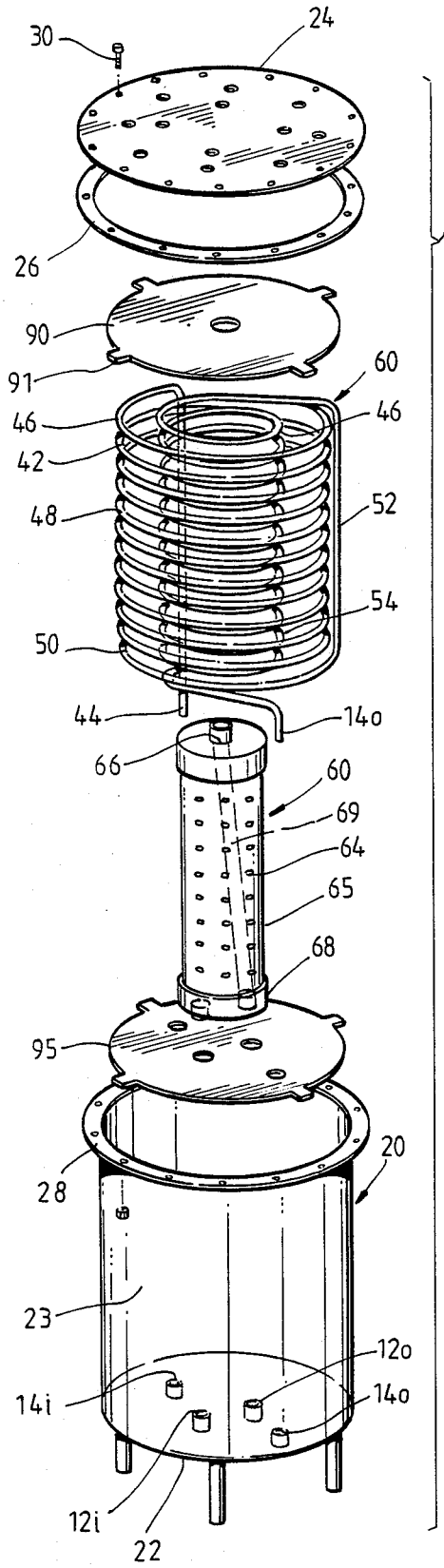
FIG. 4 is an exploded perspective view of the sealed tank portion of swimming pool water heater system.

A better understanding of the construction of swimming pool heating system 10 may be had by reference to FIG. 4. Therein it may be seen that the water flow manifold assembly 60 and refrigerant cooling coil system 40 are contained within sealed tank assembly 20. Located above the cooling coil system 40 and manifold assembly 60 is flow direction plate 90. Plate 90 assures that water near the top of tank 20 flows outwardly through the coil system 40 before exiting tank 20. If desired plate 90 may include outwardly extending fingers 91 to contact the sidewall of tank 20 thus providing stability for manifold assembly 60. Additionally, plate 90 may also include a plurality of clips (not shown) on its underside to provide stability for coil system 40. For ease of access to the interior of sealed tank assembly 20, a removable top 24 and gasket assembly 26 are used in the preferred embodiment. Removable top 24 and gasket 26 are attached to top 28 of sealed tank assembly 20 by the use of a plurality of fasteners 30. (Only one fastener is shown in FIG. 4 in an effort to keep the drawing simple.) Further adding to the rigidity of coil system 40 and manifold assembly 60 is bottom mounting plate 95. Mounting plate 95 provides additional support for coil system 40 and manifold assembly 60. While mounting plate 95 is shown in the preferred embodiment, it will be understood that plate 95 is not required for operation of the invention.

Refrigerant cooling coil system 40 is a double helix of coils 42. Warmed refrigerant flows up through first riser tube 44 to top 46 of refrigerant cooling coil system 40. Warmed refrigerant then flows downwardly through outer helix 48. Once reaching bottom 50 of outer helix 48, the partially cooled refrigerant is returned to top 46 of refrigerant cooling coil system 40 by a second riser tube 52. Once again the refrigerant flows downwardly but this time it passes through inner helix 54 before being eventually returned through outlet **14*o*** to the evaporator.

Located in the midst of inner helix 54 of refrigerant cooling coil system 40 is water flow manifold assembly 60. Water enters water flow manifold assembly 60 at base 68 and flows upwardly therethrough. It exits the generally cylindrical water flow manifold assembly 60 through a plurality of holes 64 which are formed approximately tangentially in wall 65 of water flow manifold assembly 60. The approximate tangential orientation of holes 64 imparts a cylindrical flow to the cool water from swimming pool 100. It has been found that the cylindrical flow of water imparted by the approximate tangential orientation of holes 64 with respect to wall 65 both reduces the formation of air bubbles and also deters the formation of scale on refrigerant cooling coil system 40 tubing. In addition, this flow system assures that the entire outside surface of the coils in coil system 40 are in contact with flowing water.

Once the cool swimming pool water has been warmed, it exits through top 66 of the water flow manifold assembly 60 and thence through drain tube 69 through base 22 of sealed tank assembly 20. By causing the warmed refrigerant to flow to top 46 of refrigerant coiling system 40 through riser tube 44 and allowing it to run downwardly, oil droplets will collect in the bottom coils of outer helix 48. Any remaining oil will be absorbed in the liquid refrigerant found in the lower coils of inner helix 54. Therefore, there is no oil entrapment within coil system 40. By introducing the hottest vapor at top 46 of system 40, the warmest refrigerant is closest to the warmed water which is approaching drain tube 69. Therefore, the warmest water exits sealed tank assembly 20 without imparting any unnecessary heat to refrigerant cooling coil system 40. By running the last coil through which warmed refrigerant flows adjacent to cylinder 60, the temperature of the exiting refrigerant almost approaches the temperature of the incoming water. This degree of refrigerant cooling helps reduce flashing of cooled refrigerant in its liquid state at the evaporator. This amount of refrigerant cooling by the swimming pool water promotes a more efficient operation of the air conditioner unit than by using ambient air.

Figure 6:
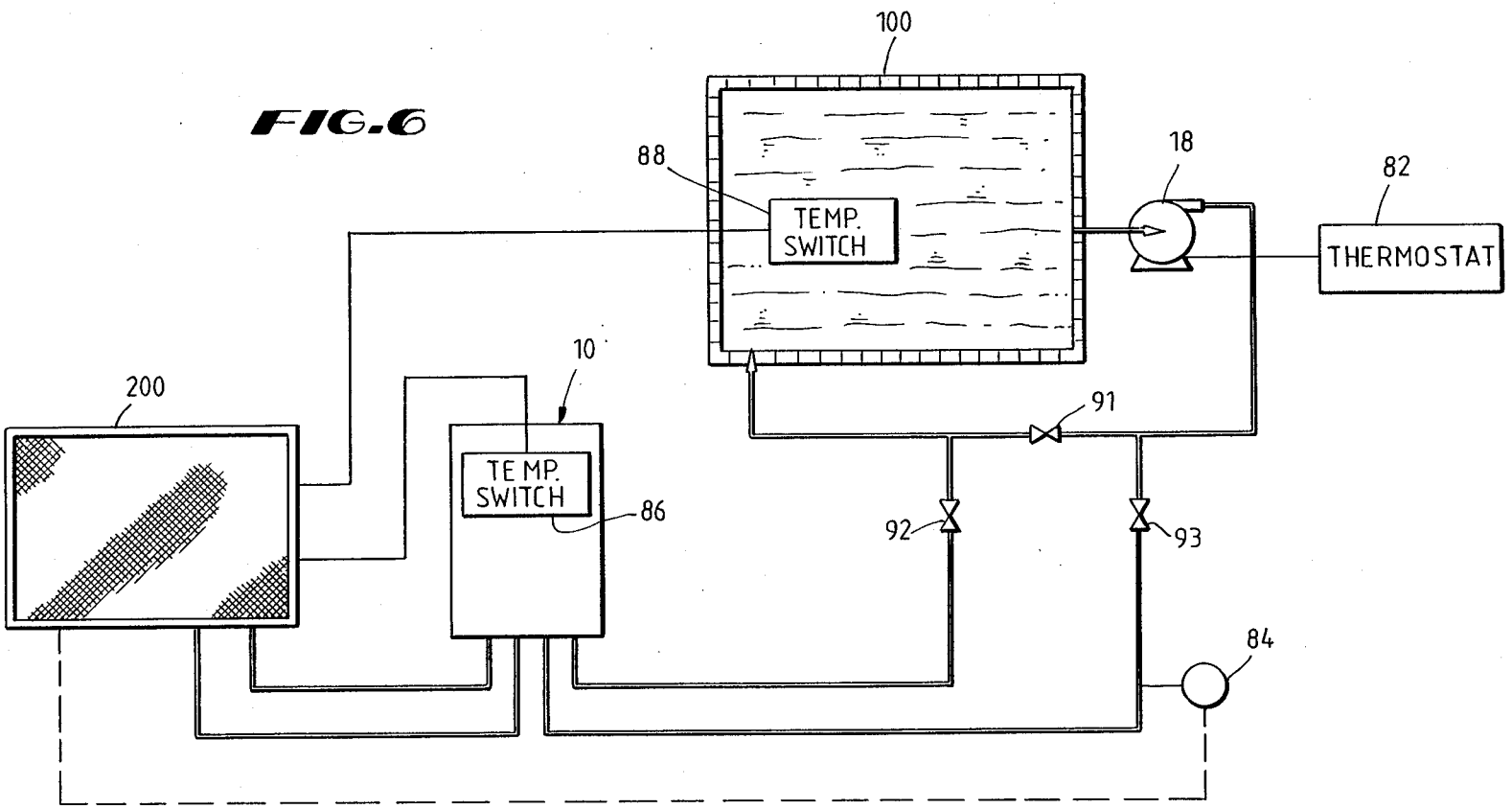
FIG. 6 is a schematic of an exemplary plumbing and electrical installation of the system of the present invention.

FIG. 6 is illustrative of how heating system 10 may be connected to normal swimming pool plumbing and to the outside air conditioner-compressor-condensor system 200 in such a way that it will permit either system, the swimming pool 100 or the air conditioner system 200 to be isolated one from the other. Herein valve 91 is closed and valves 92 and 93 are open when it is desired to utilize system 10 to heat the swimming pool water. When system 10 is taken out of service, valve 91 is opened and valves 92 and 93 are closed.

During normal pool heating operation on days when operation of the air conditioning system is required a signal from interior thermostat 82 activates circulating pump 18. When pressure sensor 84 reaches a predetermined level, the compressor in outdoor air conditioning unit 200 is turned on to begin the refrigerant cooling cycle. If the water pressure falls below the predetermined level, the air conditioning system will cut off before overheated refrigerant causes any damage. Additionally, a temperature sensing switch 86 may be installed within sealed tank assembly 20 to provide additional protection for system 10. If the warmed swimming pool water temperature rises above a predetermined setting, the air conditioning system will automatically shut down.

When heating system 10 is operating, the outside cooling fan normally used to pass ambient air over coils containing warmed refrigerant will be rendered inoperative. In its place is substituted the swimming pool water cooled condensor of the present invention. The elimination of the need for a fan contributes to a much quieter unit and lowers the cost of operation because less electricity is required. Because pump 18 is a usual part of a swimming pool water circulation and filtration system, there will be minimal increase in electricity usage to circulate water from swimming pool 100 through heating system 10.

When the swimming pool water has reached the desired temperature, a temperature sensing switch 88 may be provided to allow the air conditioner to use ambient air to cool the refrigerant with the air-cooled condensor.

It has been found that refrigerant cooling coil system 40 may be made from a standard refrigerant grade of copper tubing. A slightly oval tubular cross-section has been found to work in the preferred embodiment; however, other tubular cross-sections may be used. If desired, non-insulating coatings may be employed to further deter formulation of bubbles or scale. Other easily fabricated materials having a high heat conductivity may also be used. While two helixes are shown in the preferred embodiment, it will be understood that additional helixes may be used without departing from the scope of the invention.

Water flow distribution manifold 60 has been constructed of a plastic similar to the type of plastic used in many home residential plumbing applications. Water flow manifold 60 may also be made of other materials which are easily fabricated and can withstand the corrosive effects of flowing water.

Figure 5A:
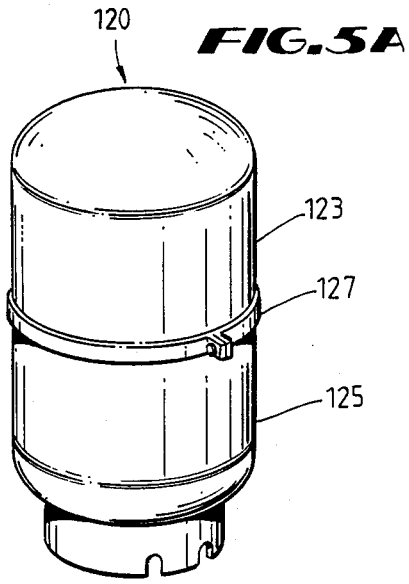
Figure 5B:
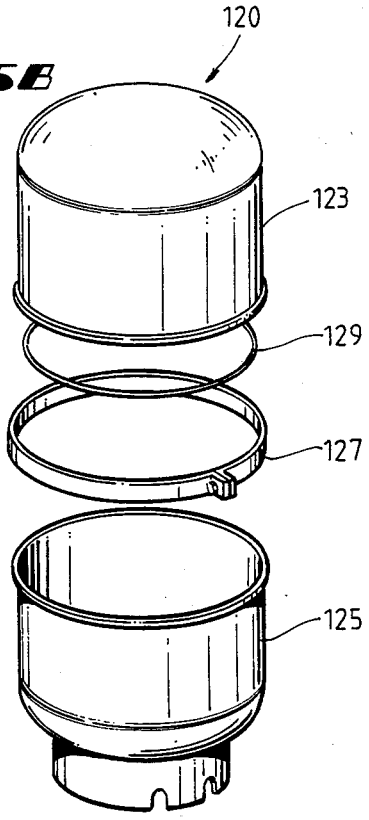

Sealed tank assembly 20 may be made in any convenient shape from metal or plastic or any suitable material which can be rendered generally leak free. As shown in FIGS. 5A and 5B, tank assembly 120 may be split in the middle into a top portion 123 and bottom portion 125. A hoop clamp 127 and gasket 129 are used to join the sections together. While bottom 22 fittings are shown in the preferred embodiment to conduct refrigerant and water into the interior 23 of sealed tank assembly 20, it will be understood that top or side fittings may be used without departing from the scope of the invention.

The swimming pool water heating system 10 of the present invention provides an inexpensive, easy to manufacture, easy to install and operate, a long lasting system for effectively warming swimming pool water. Additionally, the swimming pool water heater system of the present invention provides a flow of water of sufficient quantity and at a sufficient velocity to provide an effective amount of heat transfer from the warmed refrigerant.

With specific reference to the figures in detail, it is stressed that the particulars of the swimming pool water heating system of the present invention are shown by way of example only and for purposes of illustrative discussion. The figures present what is believed to be the most useful and readily understood description of the principals and structural concepts of the invention. In this regard, no attempt has been made to show structural details of the swimming pool heating system of the present invention in greater detail than is necessary for a fundamental understanding by one skilled in the art. The written description, taken with the drawings, will make apparent to those skilled in the art the manufacture of the invention and the method by which the invention may be embodied in practice. Specifically, the detailed showing is not to be taken as a limitation of the scope of the invention; rather the invention is to only be defined by the appended claims which, along with the drawings, form a part of the specification.

I claim:

1. A system for heating liquid which uses the waste heat from the refrigerant in an air conditioning or refrigeration system, said system comprising in operative combination:

- a sealed tank having water inlet and outlet connections and refrigerant inlet and outlet connections;
- a refrigerant cooling system contained within said sealed tank and connected to said refrigerant inlet and outlet connections;
- a substantially cylindrical water flow manifold contained within said refrigerant cooling coil system and connected to said water inlet and outlet connections, said eater flow manifold having a plurality of substantially tangentially formed holes positioned and arranged to impart a substantially cylindrical flow of liquid within said sealed tank and over said refrigerant cooling coil system;

whereby waste heat from the refrigerant in the air conditioning or refrigeration system is transferred to the liquid to be heated through said refrigerant cooling coil system.

2. The system as defined in claim 1 wherein said seal tank has a removable top.

3. The system as defined in claim 1 wherein said tank is divided into two sections.

4. The system as defined in claim 1 wherein said refrigerant cooling coil system is constructed and arranged so that warmed refrigerant is conducted at least twice over the length of said sealed tank.

5. The system as defined in claim 4 wherein said refrigerant cooling coil system includes both inner and outer coils.

6. The system as defined in claim 5 wherein said refrigerant is conducted to the top of said inner coil after passing through the bottom of said outer coil.

7. The system as defined in claim 1 wherein the area of said substantially tangentially drilled holes is approximately equal to or less than the area of said water inlet connection.

8. The system as defined in claim 1 wherein said water flow manifold further includes a drain tube so that said water may exit through the top of said manifold.

9. A swimming pool water heating system which uses the waste heat from the refrigerant in an air conditioning system, said system comprising in operative combination:

a pump;

a heater, including:

a sealed tank having water inlet and outlet connections and refrigerant inlet and outlet connections;

a refrigerant cooling coil system contained within said tank and connected to said refrigerant inlet and outlet connections;

a substantially cylindrical water flow manifold contained within said refrigerant cooling coil system and connected to said water inlet and outlet connections, said water flow manifold having a plurality of substantially tangentially formed holes positioned and arranged to impart a substantially cylindrical flow of swimming pool water within said sealed tank and over said refrigerant cooling coil system;

means for coupling said pump to said heater;

whereby swimming pool water is caused to flow to said heater by said pump and the waste heat from the refrigerant in the air conditioning system is transferred to the swimming pool water through the refrigerant cooling coil system within said sealed tank.

10. The system as defined in claim 9 wherein said sealed tank has a removable top.

11. The system as defined in claim 9 wherein said tank is divided into two sections.

12. The system as defined in claim 11 wherein said refrigerant cooling coil system is constructed and arranged so that warmed refrigerant enters at the top of said refrigerant cooling coil system.

13. The system as defined in claim 12 wherein said refrigerant cooling coil system includes both inner and outer coils.

14. The system as defined in claim 13 wherein said refrigerant is conducted to the top of said inner coil after passing through the bottom of said outer coil.

15. The system as defined in claim 9 wherein the area of said tangentially drilled holes is approximately equal to or less than the area of said water inlet connection.

16. The system as defined in claim 9 wherein said water flow manifold further includes a central pipe so that said water may exit through the top of said manifold.

* * * * *